US009231334B2

(12) United States Patent
Hara

(10) Patent No.: US 9,231,334 B2
(45) Date of Patent: Jan. 5, 2016

(54) CONNECTOR

(71) Applicant: Sumitomo Wiring Systems, Ltd., Yokkaichi, Mie (JP)

(72) Inventor: Teruo Hara, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/542,894

(22) Filed: Nov. 17, 2014

(65) Prior Publication Data

US 2015/0162698 A1 Jun. 11, 2015

(30) Foreign Application Priority Data

Dec. 9, 2013 (JP) ..... 2013-253975

(51) Int. Cl.

| | |
|---|---|
| ***H01R 13/52*** | (2006.01) |
| ***H01R 13/518*** | (2006.01) |
| *H01R 12/72* | (2011.01) |
| *H01R 13/629* | (2006.01) |

(52) U.S. Cl.

CPC ..... *H01R 13/5227* (2013.01); *H01R 13/518* (2013.01); *H01R 13/5219* (2013.01); *H01R 12/724* (2013.01); *H01R 13/62933* (2013.01)

(58) Field of Classification Search

CPC ..... H01R 13/5227

See application file for complete search history.

(56) References Cited

U.S. PATENT DOCUMENTS

| | | | | |
|---|---|---|---|---|
| 4,793,819 | A * | 12/1988 | Berg | H01R 13/5227 174/67 |
| 5,343,547 | A * | 8/1994 | Palecek | G02B 6/3879 385/76 |
| 6,113,407 | A * | 9/2000 | Martin | H01R 13/521 439/205 |
| 2008/0020619 | A1* | 1/2008 | Shigeta | B26B 19/3833 439/271 |
| 2008/0268706 | A1* | 10/2008 | Sheng | H01R 13/5213 439/587 |
| 2013/0078846 | A1* | 3/2013 | Sasaki | B60L 11/1818 439/374 |
| 2015/0064948 | A1* | 3/2015 | Hara | H01R 13/5227 439/205 |
| 2015/0162698 | A1* | 6/2015 | Hara | H01R 13/518 439/157 |

FOREIGN PATENT DOCUMENTS

JP 2013-143286 7/2013

* cited by examiner

*Primary Examiner* — James Harvey

(74) *Attorney, Agent, or Firm* — Gerald E. Hespos; Michael J. Porco; Matthew T. Hespos

(57) ABSTRACT

A connector is configured such that a casing for covering a board is to be mounted on an upper surface of a housing. Connector fitting receptacles are provided side by side in the housing while being spaced apart in a horizontal direction and mating connectors can fit therein. A lever accommodating receptacle is arranged above the connector fitting receptacles and receives a lever for assisting a connection to the mating connector. An upwardly open groove extends along an arrangement direction of the connector fitting receptacles and is provided behind the lever accommodating receptacle in a connecting direction to the mating connector. A hole is provided on a bottom part of the groove and communicates with a clearance between adjacent connector fitting receptacles.

5 Claims, 12 Drawing Sheets

CONNECTOR

BACKGROUND

1. Field of the Invention

The invention relates to a connector.

2. Description of the Related Art

Japanese Unexamined Patent Publication No. 2013-143286 discloses a connector to be connected to a board. The connector has a housing and terminal fittings extending from the rear surface of a housing are connected to a board. The board is covered by a casing to prevent contact with foreign substances. The connector is fixed at an edge of the board and the casing covers the entire upper surface of the board and a part of the upper surface of the housing.

A drip-proof sheet generally is laid to prevent the entry of liquid, such as water, through a clearance between the casing and the housing. However, to further enhance waterproofness, there has been a demand for preventing the entry of liquid to the board along the upper surface of the housing even if the liquid enters this clearance.

The invention was completed based on the above situation and aims to provide a connector capable of preventing the entry of liquid to a board side along an upper surface of a housing.

SUMMARY OF THE INVENTION

The invention is directed to a connector with a housing and a casing mounted on an upper surface of the housing for covering a board. The housing includes horizontally spaced connector fitting receptacles into which a mating connector can fit. A lever accommodating receptacle is arranged above the connector fitting receptacles and can receive a lever for assisting a connecting operation to the mating connector. An upwardly open groove is provided behind the lever accommodating receptacle and extends along an arrangement direction of the connector fitting receptacles. A hole is provided on a bottom part of the groove and communicates with a clearance between adjacent connector fitting receptacles. According to this configuration, liquid on the upper surface of the housing drops into the groove before intruding to the board and drains through the hole in the bottom of the groove and into a clearance between adjacent connector fitting receptacles to prevent entry of the liquid to the board.

A drainage rib may be provided on an outer side surface of the connector fitting receptacle and inclines down toward a front side in the connecting direction to the mating connector. Thus, liquid that drops from the hole of the groove and reached the outer side surface of the connector fitting receptacle can be drained reliably along the drainage rib toward the front side in the connecting direction to the mating connector, i.e. in a direction away from the board.

The groove portion may be open on end parts in the arrangement direction of the connector fitting receptacles. Accordingly, the liquid that reaches the groove can be drained from the hole and also from the end part of the groove. Therefore, the entry of the liquid to the board along the upper surface of the housing is prevented more reliably.

The groove may be inclined down toward the ends from a central part of the bottom part in the arrangement direction of the connector fitting receptacles so that the liquid can be drained more easily.

A length of the lever accommodating receptacle in the connecting direction to the mating connector may be shorter than the connector fitting receptacles in the connecting direction and the groove may be above the connector fitting receptacles. Thus, space behind the lever accommodating receptacle can be utilized efficiently and the hole can be formed vertically on the bottom of the groove to facilitate manufacturing.

DETAILED DESCRIPTION

An embodiment of the invention is described with reference to FIGS. 1 to 11. A connector in this embodiment is an airbag connector to be connected to an airbag circuit and includes a male connector 10 that is connectable to female connectors 40. The male connector 10 and the female connectors 40 are lever-type connectors, and connecting and separating operations are assisted by rotating levers 43 on the female connectors 40. Hereinafter, in each constituent member, an end to be connected to a mating member is referred to as the front and the opposite end is referred to as the rear. Upper and lower sides of FIG. 2 are referred to as upper and lower sides. Further, a right and left sides of FIG. 4 are referred to as right and left sides.

Figure 1:
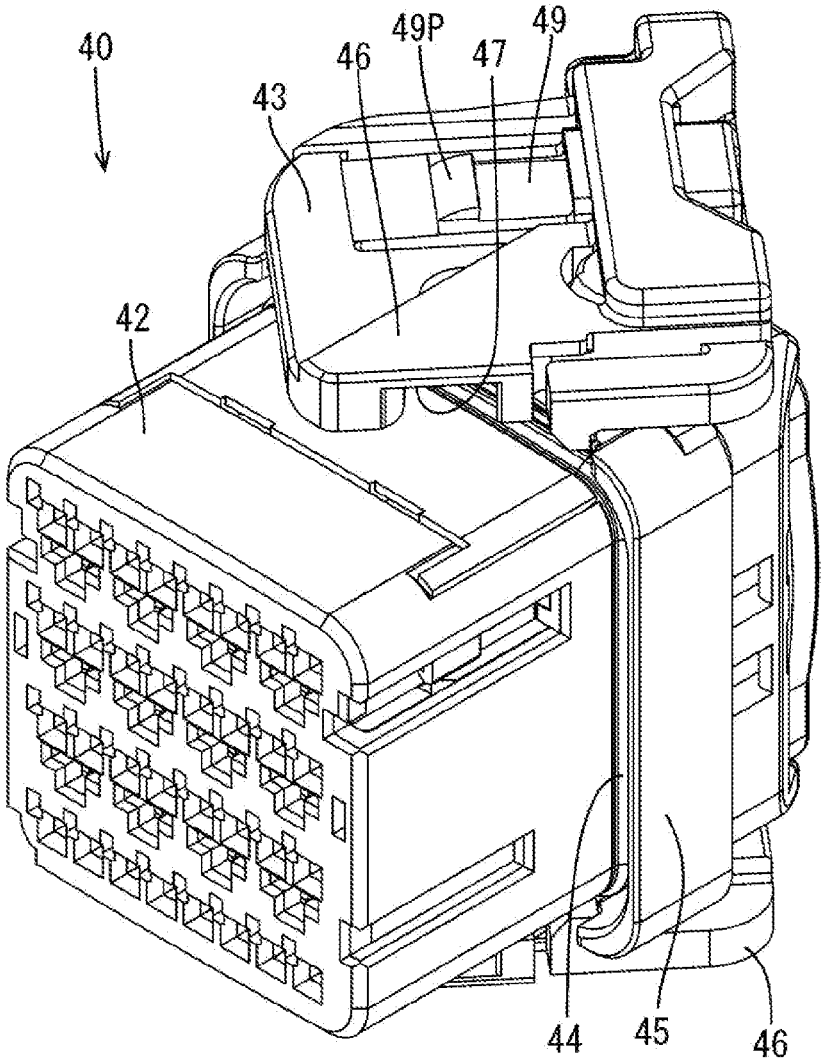
FIG. 1 is a perspective view of a female connector according to an embodiment.
Figure 2:
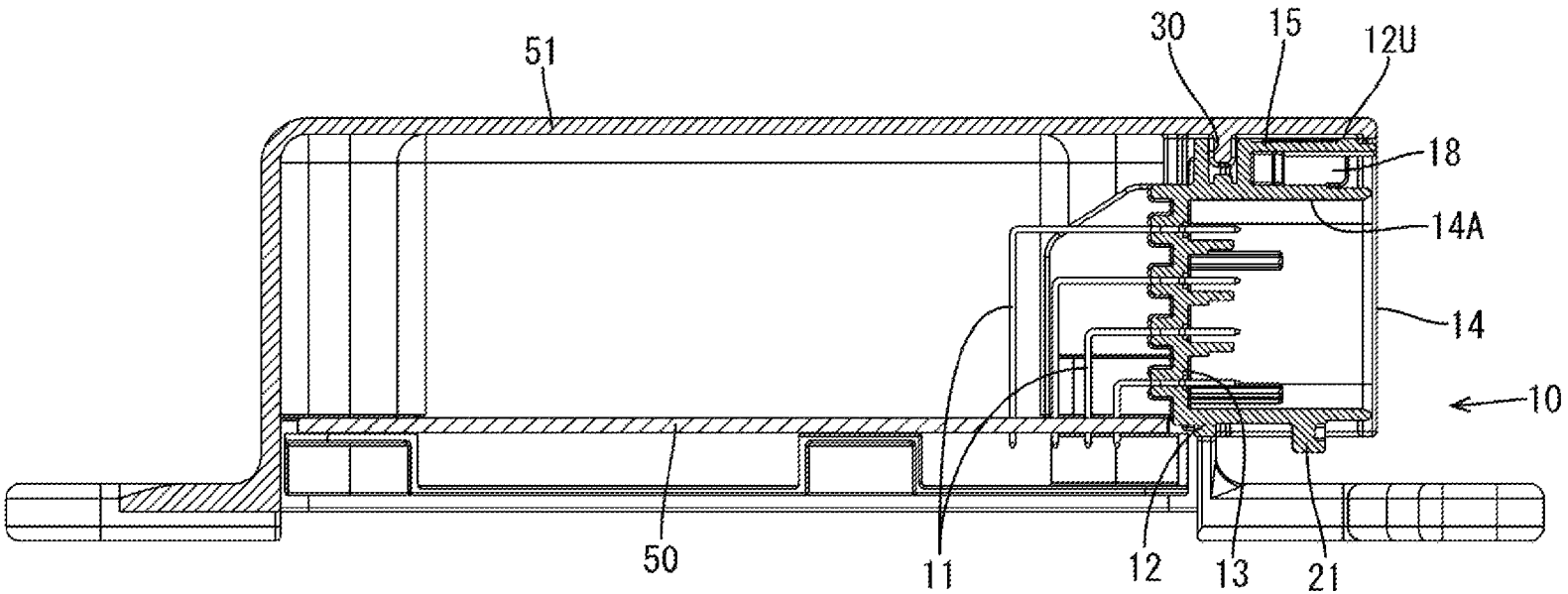
FIG. 2 is a section of a male connector according to the embodiment showing the male connector is connected to a board and a casing is mounted.

As shown in FIG. 1, the female connector 40 is configured so that the lever 43 is mounted on a female housing 42 for holding female-type terminals. The female housing 42 is made of synthetic resin and is a substantially rectangular block that has the female terminals accommodated therein.

A substantially rectangular seal ring 44 is fit on the outer peripheral surface of the female housing 42 and is sandwiched between the outer peripheral surface of the female housing 42 and the inner peripheral surface of a first receptacle 14 of the male connector 10 in a properly connected state of the female connector 40 and the male connector 10, thereby holding the interior of the first receptacle 14 in a sealed state. Note that a female-side receptacle 45 to be fit externally on the tip of the first receptacle 14 is provided at an outer side of the seal ring 44 to cover the seal ring 44.

The lever 43 for assisting the connecting operation to the male connector 10 is rotatably mounted on the female housing 42. The lever 43 is substantially U-shaped with two cam plates 46 joined by an operating portion (not shown). Each cam plate is formed with a cam groove 47.

Entrances of the cam grooves 47 face forward at an initial position of the lever 43. The two connectors 10, 40 are connected lightly and cam pins 20 of the male connector 10 are introduced through the entrances of the cam grooves 47. The lever 43 then is rotated from the initial position toward a connection position. Thus, the cam pins 20 move along the cam grooves 47 and the two connectors 10, 40 are pulled toward each other by a cam action based on the engagement of these cam pins 20 and the cam grooves 47. When the lever 43 reach the connection position, the cam pins 20 reach back ends of the cam grooves 47 and the two connectors 10, 40 are connected properly.

The cam plate 46 has a lock arm 49 that is resiliently deflectable in a thickness direction of the cam plate 46, and a lock projection 49P is formed in a lengthwise central part of the lock arm 49. The lock projection 49P fits into a lock hole 23 of the male connector 10 to lock the connectors 10, 40 in the properly connected state.

The male connector 10 includes male terminals 11 and a male housing 12 for holding the male terminals 11. As shown in FIG. 2, the mating connector 10 is a board connector and the male terminals 11 extending from the male housing 12 are connected to a board 50 arranged behind the male housing 12. A casing 51 for covering the board 50 is mounted on the side of an upper surface 12U of the male housing 12.

The male housing 12 is made of a synthetic resin and includes a holding wall 13, through which the male terminals 11 penetrate in a front-back direction. First receptacles 14 extend forward from the front surface (right surface of FIG. 2) of the holding wall 13 and are spaced apart in a horizontal direction, as shown in FIG. 4, and a second receptacle 15 collectively covers the first receptacles 14 from above (see FIG. 3). The male housing 12 is shaped wide in the lateral direction.

Each first receptacle 14 is a substantially rectangular tube and opens forward, and the interior thereof serves as a connector fitting portion 14A into which the female connector 40 can tightly fit. The first receptacle 14 located in a lateral center is wider than those located on opposite ends (see FIG. 4). All three first receptacles 14 have the same height. Further, the three first receptacles 13 are arranged side by side on the holding wall 13 at the same height. Note that the height of the first receptacles 14 and the height of the holding wall 13 are equal.

The male terminals 11 are formed by bending rectangular wire materials made of electrically conductive metal into an L shape and are held by being press-fit into terminal insertion holes 13A in the holding wall 13. One end of each male terminal 11 projects into the corresponding first receptacle 14 (see FIG. 8). The other end of each male terminal 11 extends back from the holding wall 13, is bent at a right angle to extend down, is inserted into an unillustrated through hole on the board 50 and is connected to an unillustrated conductive path, such as by soldering (see FIG. 2).

Figure 3:
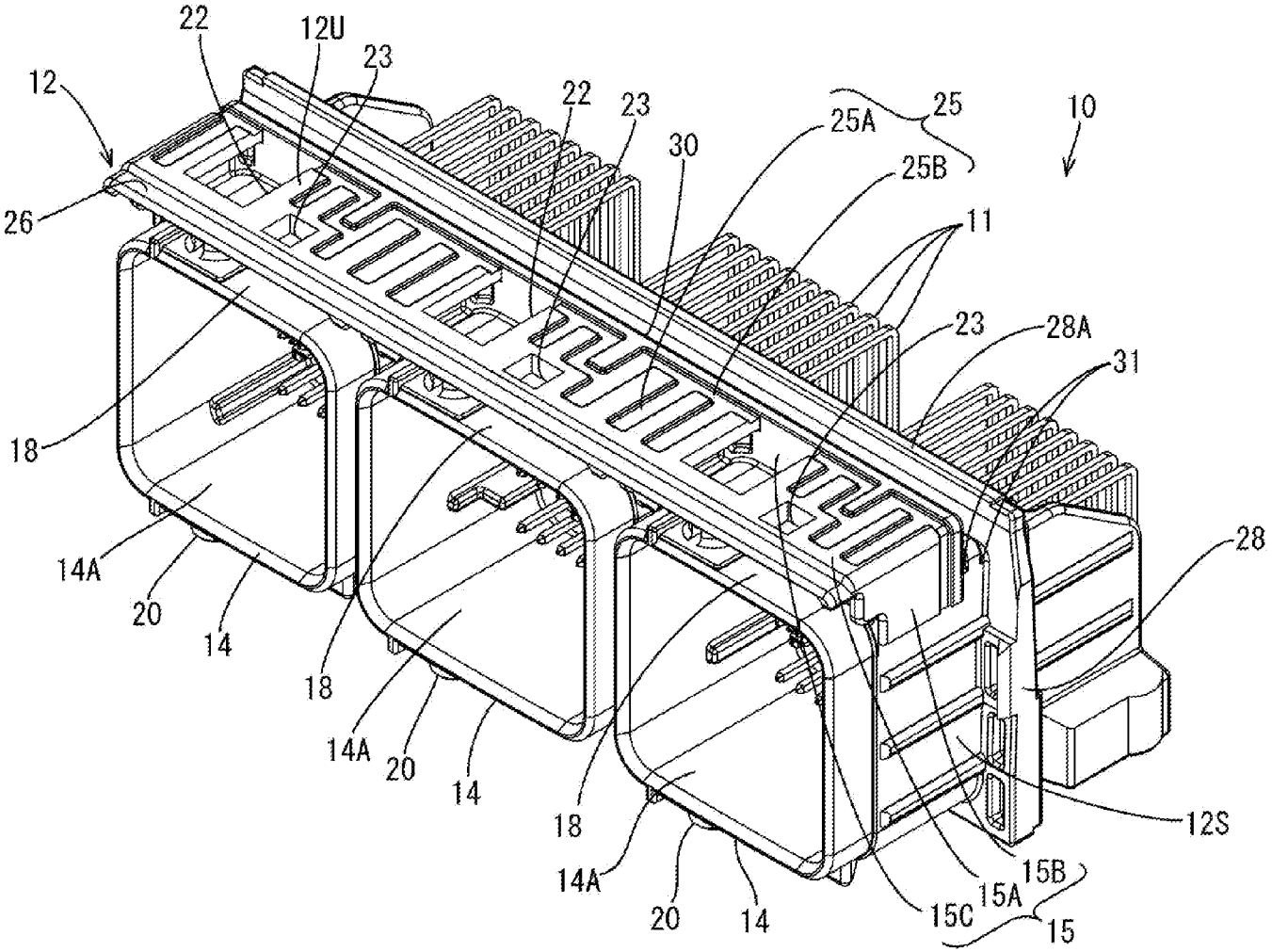
FIG. 3 is a perspective view of the male connector.
Figure 4:
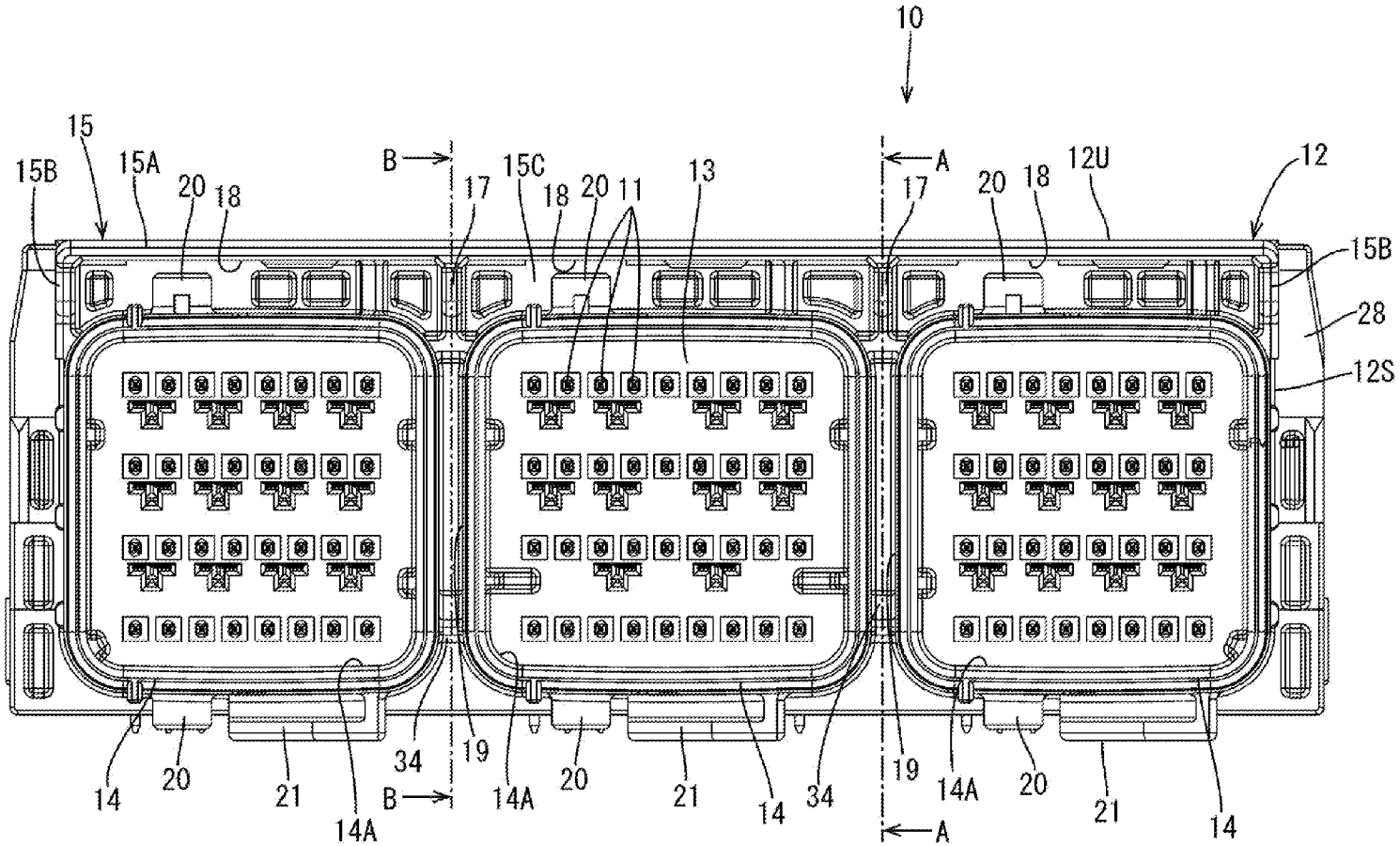
FIG. 4 is a front view showing the male connector.
Figure 8:
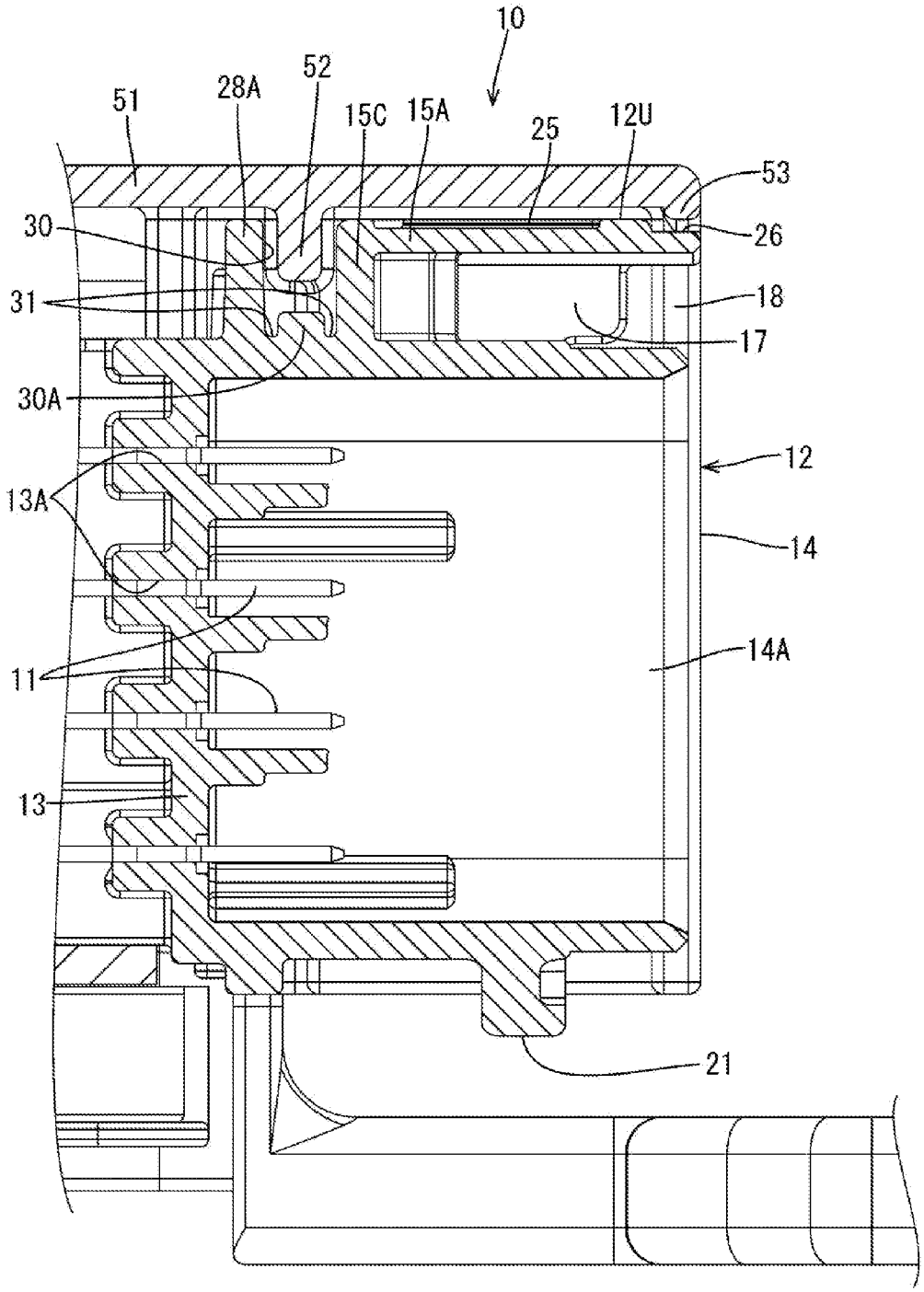
FIG. 8 is a partial enlarged section of FIG. 2.

The second receptacle 15 is formed to collectively cover areas of the respective first receptacles 14 from a position slightly behind a center in the front-back direction to the front end from above and includes an upper wall 15A, two side walls 15B extending down from lateral end edges of the upper wall 15A and a back wall 15C extending down from the rear end edge of the upper wall 15A, as shown in FIGS. 3 and 8. The upper wall 15A forms the upper surface 12U of the male housing 12. The lower end of the side wall 15B is coupled unitarily to a side wall of the first receptacle 14. The back wall 15C integrally couples the upper wall 15A and the first receptacles 14. Further, as shown in FIG. 4, partition walls 17 having an inverted T shape when viewed from the front extend down and are configured to partition a space between the upper wall 15A and the receptacles 14 and between this space and clearances 19 between adjacent first receptacles 14 are provided at positions of the upper wall 15A corresponding to the clearances 19.

Lever accommodating portions 18 are enclosed by the upper wall 15A, the side walls 15B, the partition walls 17, the back wall 15C and the upper surface of the first receptacle 14 for accommodating the levers 43 when the two connectors 10, 40 are connected. Each lever accommodating portion 18 is open forward and one lever accommodating portion 18 is provided for each connector fitting portion 14A (see FIGS. 3 and 4).

Pairs of cylindrical cam pins 26 are provided on the male housing 12. One pair of cam pins 20 are provided on the upper and lower surfaces of each first receptacle 14 (see FIG. 4). More specifically, the cam pin 20 on the upper surface of the first receptacle 14 projects up in the lever accommodating portion 18 and the cam pin 20 on the lower surface of the first receptacle 14 projects down at a position coaxial with the cam pin 20 in the lever accommodating portion 18. The cam pins 20 are at positions closer to a left side than a lateral center of each lever accommodating portion 18.

A cam plate fitting portion 21 is provided on the lower surface of the first receptacle 14 and can receive a peripheral part of the cam plate 46 of the lever 43. The cam plate fitting portion 21 prevents a deformation of the lever 43 that could separate the cam plate 46 downward from the male housing 12.

Figure 5:
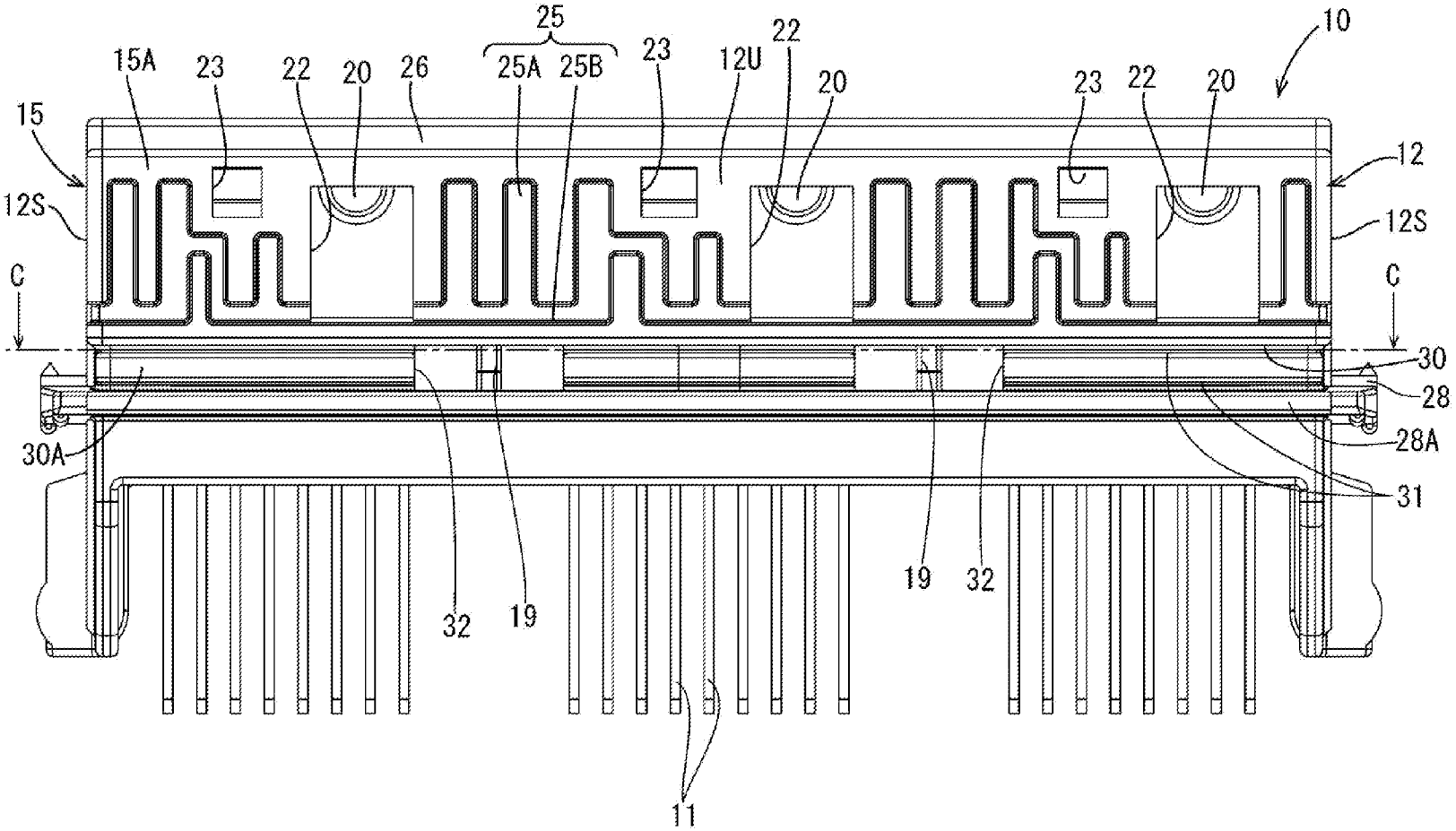
FIG. 5 is a plan view showing the male connector.
Figure 6:
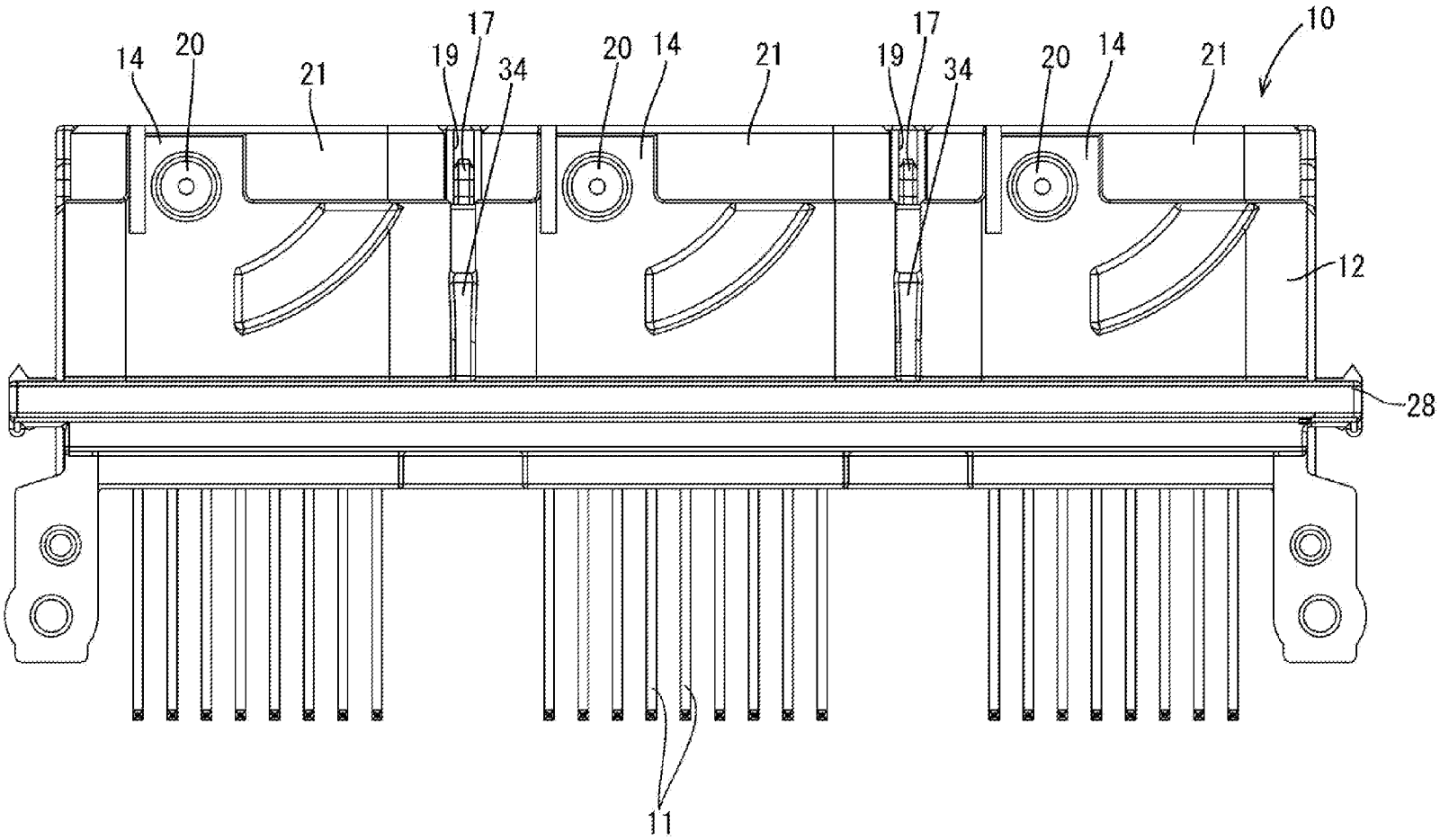
FIG. 6 is a bottom view showing the male connector.

As shown in FIGS. 3 and 5, openings 22 are formed on the upper wall 15A of the second receptacle 15. The openings 22 are mold removal holes for forming the rear surfaces of the cam pins 20. The opening 22 extends from a center of each cam pin 20 to a position near the back wall 15C of the lever accommodating portion 18, has a rectangular shape slightly longer in the front-back direction and penetrates through the upper wall 15A. One opening 22 is provided for each cam pin 20 provided in the lever accommodating portions 18.

As shown in FIGS. 3 and 5, lock holes 23 are provided on the upper wall 15A. The lock holes 23 are square and penetrate through the upper wall 15A and one lock hole 23 for each of the first receptacles 14. The lock projection 49A provided on the lever 43 is fit into each lock hole 23 to be locked. The lock hole 23 is provided at a position slightly closer to a right side than a lateral center of the corresponding lever accommodating portion 18.

As shown in FIGS. 3 and 5, liquid retaining portions 25 are formed on the upper surface 12U (upper wall 15A) of the male housing 12 by connecting longitudinal grooves 25A extending in the front-back direction and lateral grooves 25B extending laterally. The liquid retaining portions 25 are arranged at left and right sides of the openings 22 in the upper wall 15A. Each liquid retaining portion 25 reaches the side surface 12S of the male housing 12 (outer surface of the side wall 15B of the second receptacle 15) or the opening 22. Depths of the longitudinal grooves 25A and the lateral grooves 25B of the liquid retaining portions 25 are substantially constant in their entireties.

A recess 26 is provided on the upper surface 12U (upper wall 15A) of the male housing 12 and to correspond to a bulge 53 bulging down along the outer peripheral edge of the casing 51 (see FIG. 8). The recess 26 is formed over the entire width of the male housing 12 (upper wall 15A) along the front edge of the upper surface 12U of the male housing 12 (see FIG. 3).

Figure 7:
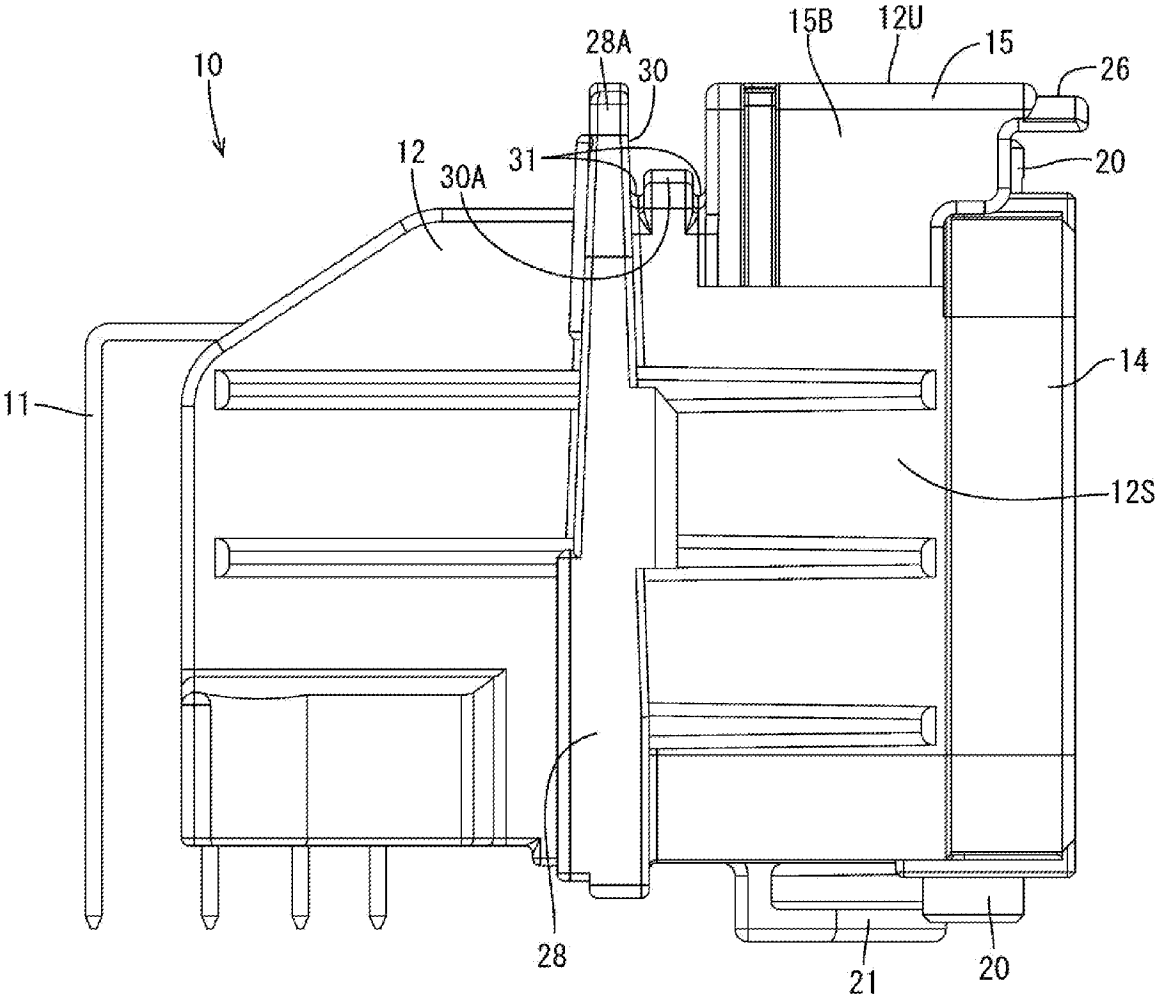
FIG. 7 is a side view showing the male connector.

A waterproof rib 28 is provided near the rear end of the male housing 12. As shown in FIG. 8, the waterproof rib 28 stands up outwardly from the outer surfaces of the respective first receptacles 14 behind the second receptacle 15 and before the holding wall 13 in the front-back direction (see FIGS. 3 and 4). The waterproof rib 28 is provided continuously over the entire periphery of the male housing 12 and has a function of preventing the entry of water to a rear side. If a part of the waterproof rib 28 provided on the first receptacles 14 is an upper rib 28A, the height of the upper rib 28A is equal to that of the second receptacle 15 as shown in FIGS. 7 and 8.

A space between the upper rib 28A and the back wall 15C of the second receptacle 15 defines a groove 30 that opens up. The groove 30 has a depth equal to the height of the second receptacle 15 and extends along a width direction (arrangement direction of the first receptacles 14) of the male housing 12, and opens on opposite side surfaces 12S of the male housing 12. Note that a fitting wall 52 provided on the casing 51 is fit into this groove portion 30 as shown in FIG. 8.

A dividing wall 30A is provided at a center position of a groove width on a bottom part of the groove 30 and projects up along the width direction of the male housing 12. The dividing wall 30A forms two upper drainage grooves 31 side by side in the front-back direction on the bottom part of the groove 30. The front drainage groove 31 extends along the back wall 15C of the second receptacle 15 and the rear drainage groove 31 extends along the front surface of the upper rib 28A over the entire width of the male housing 12. Opposite ends of the upper drainage grooves 31 reach the opposite side surfaces 12S of the male housing 12 and are open thereon, as shown in FIGS. 3 and 7. Further, bottom parts of the upper drainage grooves 31 are inclined down from a center of the male housing 12 in the width direction toward the opposite side surfaces 12S of the male housing 12 (see FIG. 11).

A hole 32 is provided at a position of the bottom part of the groove 30 corresponding to each clearance 19, i.e. behind the partition wall 17 for allowing communication between the groove 30 and the clearance 19 between adjacent first receptacles 14 (see FIG. 5). A width of the hole 32 in the front-back direction is equal to the width of the groove 30. Further, a width of the hole 32 in the lateral direction exceeds the width of the clearance 19 so that the vicinities of upper corners of the first receptacles 14 are exposed (see FIG. 11).

Figure 9:
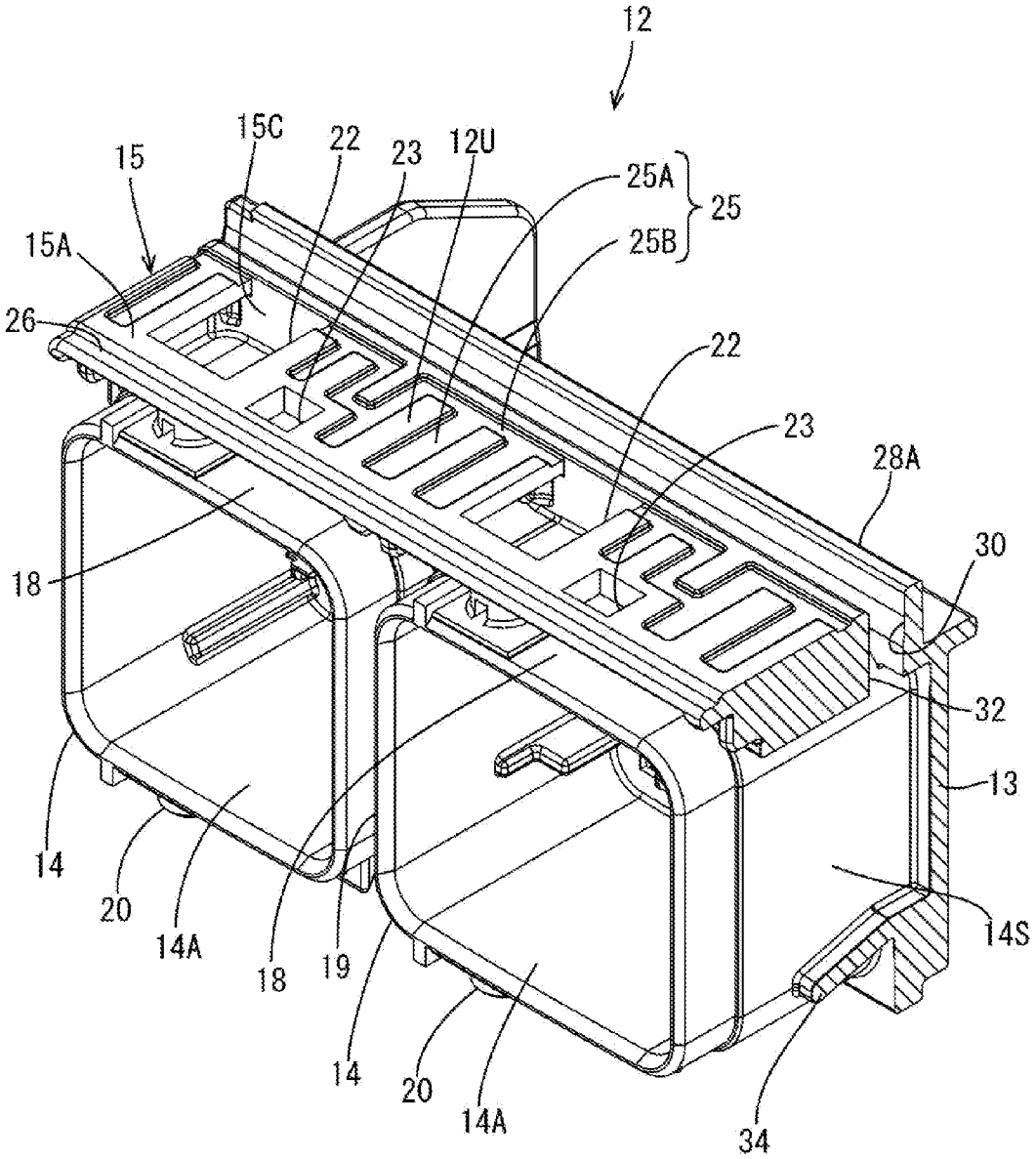
FIG. 9 is a perspective view of a male housing partly in section along A-A of FIG. 4.
Figure 10:
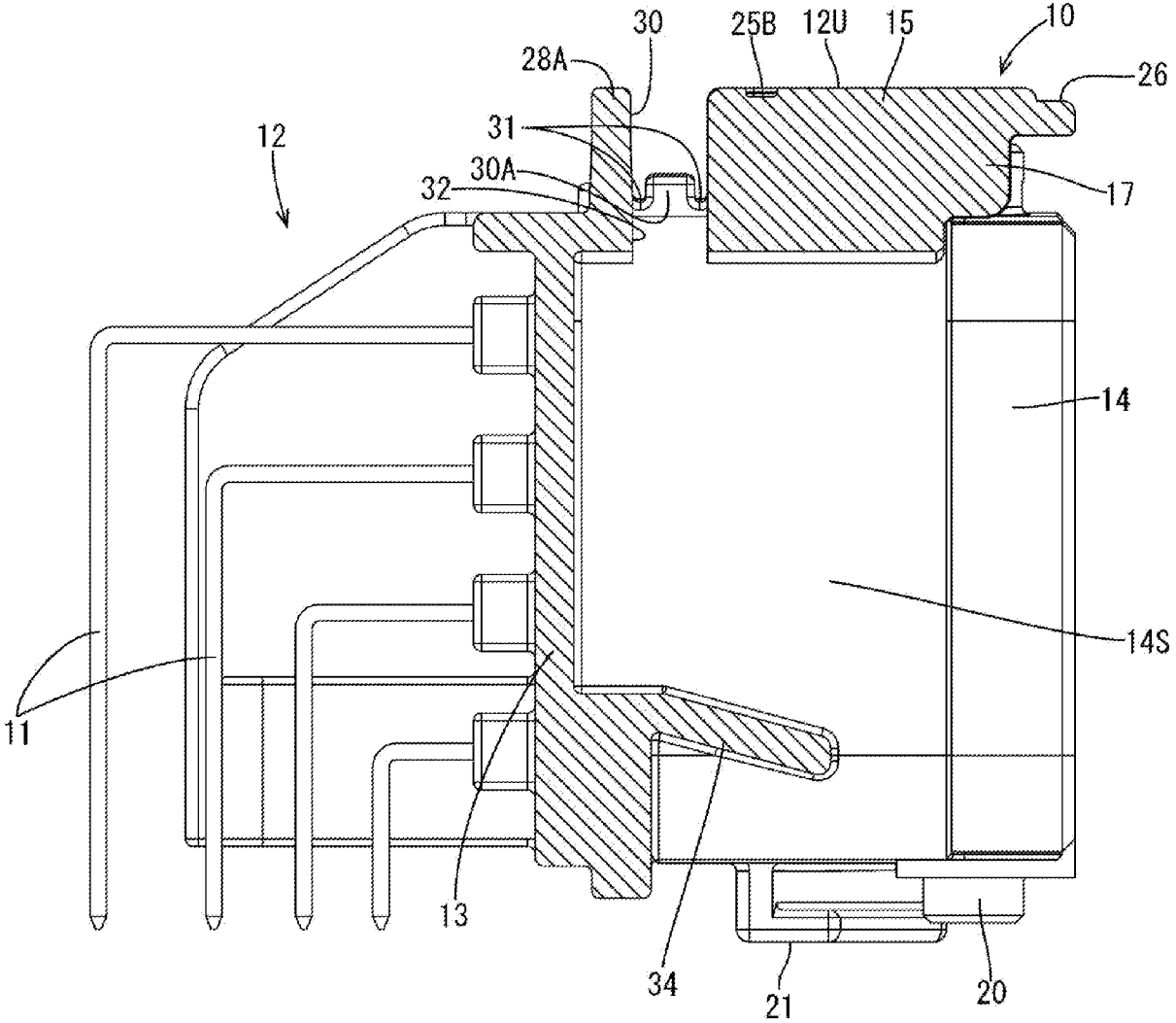
FIG. 10 is a section along B-B of FIG. 4.
Figure 11:
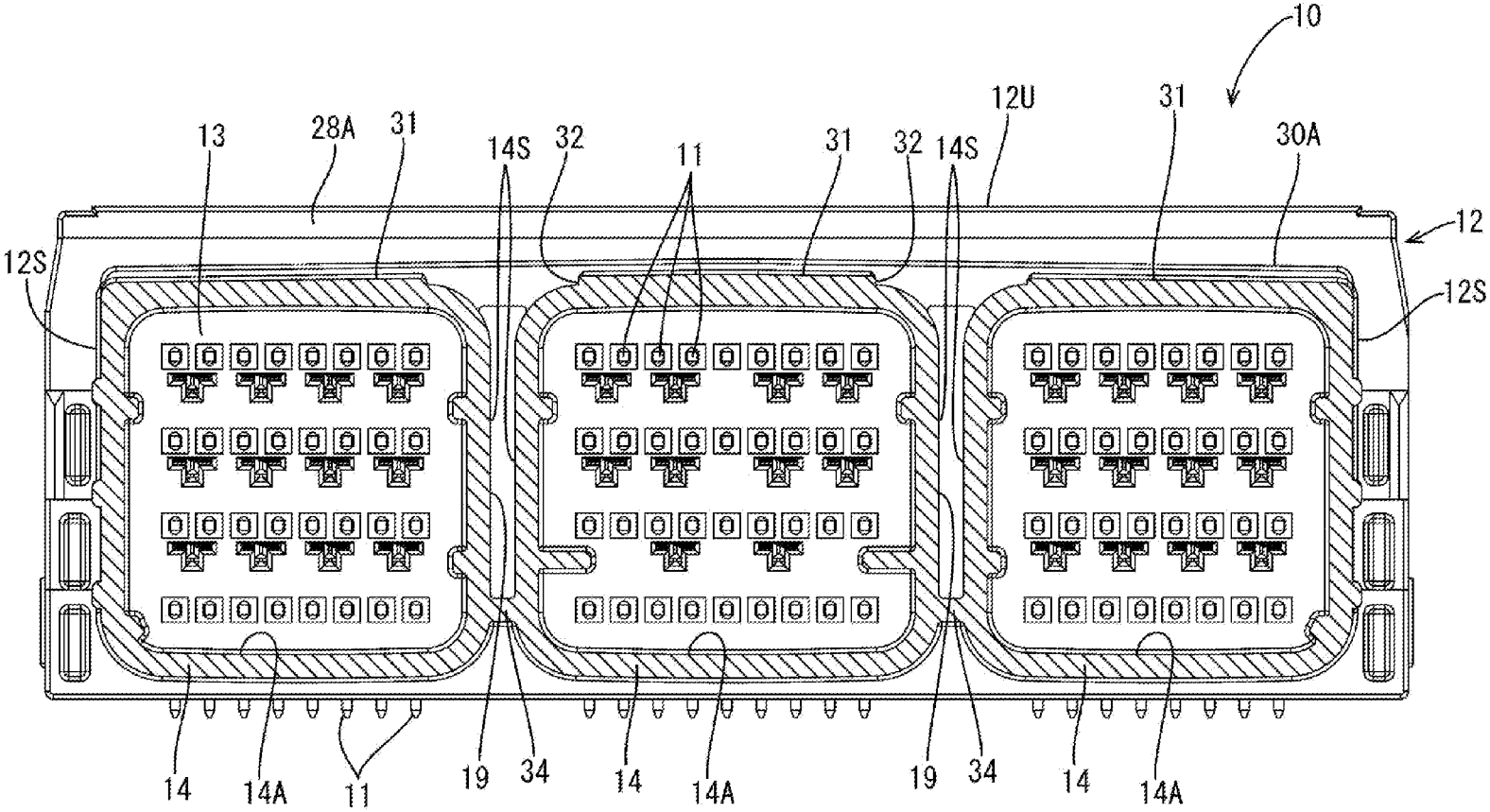
FIG. 11 is a section along C-C of FIG. 5.

Drainage ribs 34 are provided on outer side surfaces 14S of the first receptacles 14 located below the holes 32, i.e. at positions near the lower ends of the outer side surfaces 14S of the first receptacles 14 facing the clearances 19. As shown in FIGS. 9 and 10, the drainage rib 34 extends horizontally along the outer side surface 14S of the first receptacle 14 from the rear end of the outer side surface 14S, i.e. from the holding wall 13 and then inclines down toward the front up to the vicinity of a center of the first receptacle 14 in the front-back direction by being bent below the hole 32. The drainage rib 34 couples the outer surfaces 14S of adjacent first receptacles 14.

Liquid could enter through a clearance between the casing 51 and the upper surface 12U of the male housing 12 (clearance between the bulge 53 and the recess 26) of the male connector 10 and could adhere to the upper surface 12U of the male housing 12. The liquid drops into the liquid retaining portion 25 and spreads in the liquid retaining portion 25 along wall surfaces of the longitudinal grooves 25A and the lateral grooves 25B of the liquid retaining portion 25. The liquid retained in the liquid retaining portion 25 reaches the side surface 12S of the male housing 12 or the opening 22 and drops down to be discharged to the outside of the male housing 12.

Liquid that spreads farther to the back beyond the liquid retaining portion 25 drops into the groove 30 beyond the second receptacle 15 and spreads into the upper drainage grooves 31. Any liquid that reaches the hole 32 in the upper drainage grooves 31 drops from the opening edge of the hole 32, further drops down in the clearance 19 between the adjacent first receptacles 14 along the outer surfaces of the first receptacles 14, i.e. the outer side surfaces 14S from the upper corners of the first receptacles 14 and eventually reaches the drainage rib 34. The liquid then is discharged obliquely down toward the front of the male housing 12 along the upper surface of the drainage rib 34.

On the other hand, liquid that reaches the side surface 12S of the male housing 12 from the upper drainage grooves 31 is discharged to the outside along the side surface 12S of the male housing 12 from end parts of the upper drainage grooves 31.

As described above, even if liquid should enter through the clearance between the casing 51 and the upper surface 12U of the male housing 12 and intrude to the back, that liquid drops into the groove 30 and eventually drops down from the hole 32 to be discharged to the outside of the male housing 12. Thus, the entry of that liquid to the side of the board 50 can be prevented reliably.

In addition, the drainage rib 34 is inclined down toward the front, and liquid that reaches the drainage rib 34 is drained reliably away from the board 50.

Further, the bottom part of the groove 30 is inclined down toward the ends from the widthwise central part of the male housing 12 and the end parts are open on the side surfaces 12S of the male housing 12. Thus, liquid that reaches the groove 30 is drained not only from the hole 32, but also from the end part of the groove 30. Therefore, entry of the liquid to the side of the board 50 can be prevented more reliably.

A dimension of the second receptacle 15 in the front-back direction is shorter than that of the first receptacles 14 in the front-back direction and the groove 30 is arranged in an extra space behind the second receptacle 15. Thus, the space is not wasted and the male connector 10 can be reduced in size while the groove 30 is provided. Further, the holes 32 can be formed vertically on the bottom part of the groove 30, thereby facilitating manufacturing.

The present invention is not limited to the above described embodiment. For example, the following embodiments also are included in the scope of the invention.

Figure 12:
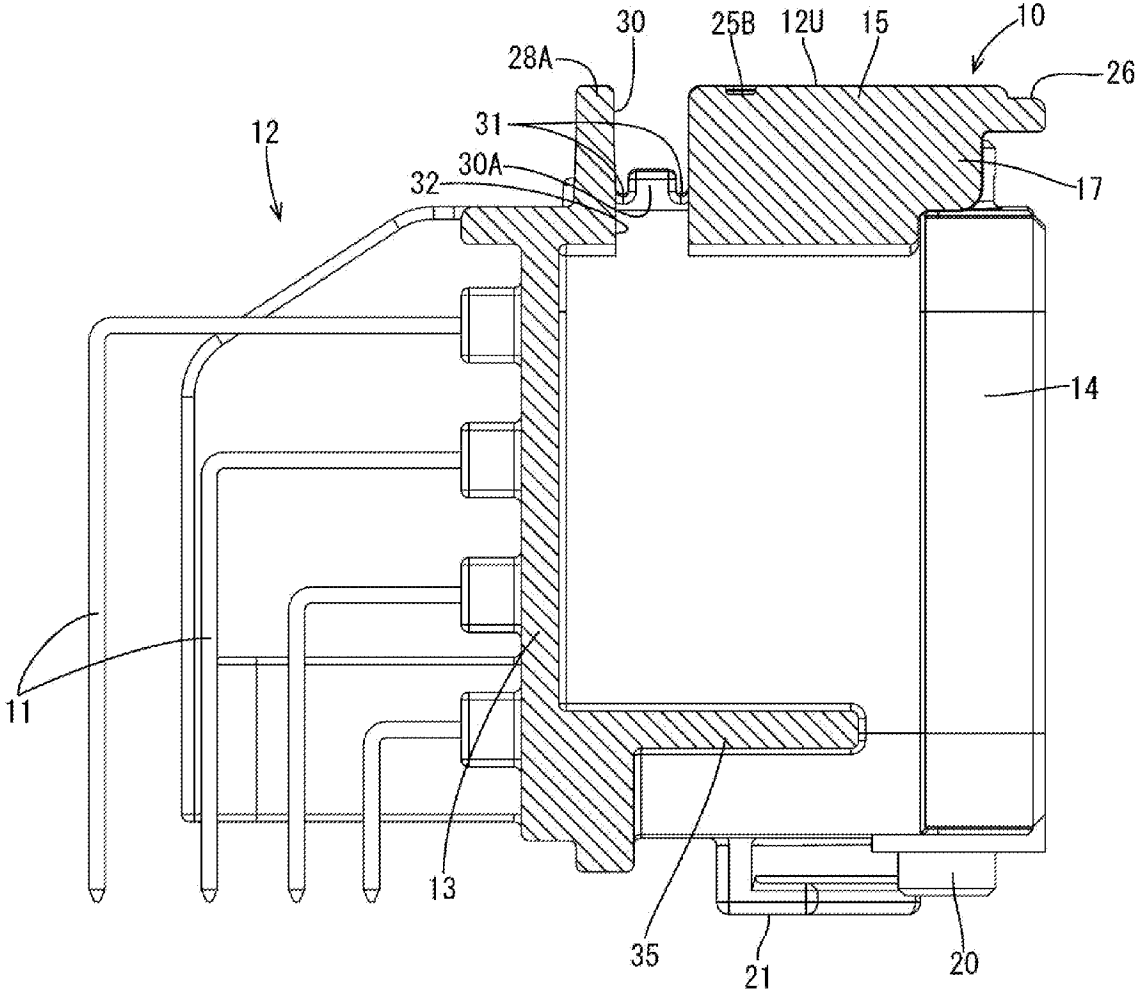
FIG. 12 is a section showing a male connector of another embodiment.

The drainage ribs 34 provided on the outer side surfaces 14S of the first receptacles 14 are inclined down toward the front in the above embodiment. However, drainage ribs 35 may be horizontal with no incline, for example, as shown in FIG. 12. Alternatively, no drainage rib may be provided.

Opposite ends of the groove 30 are open on the side surfaces 12S of the male housing 12 in the above embodiment. However, they may not necessarily be open and all the liquid in the groove 30 may drain from the holes 32.

The bottom of the groove 30 is inclined down toward the side surfaces 12S from the widthwise center of the male housing 12 in the above embodiment. However, it may not be inclined and may be horizontal.

The shape and size of the holes 32 are not limited to those of the above embodiment and can be appropriately changed.

The groove 30 is above the first receptacles 14 in the above embodiment, but it may be behind the first receptacles 14. In such a case, the groove 30 and the clearances 19 can communicate by inclining the holes 32 down toward the front.

The three first receptacles 14 have the same height and are side by side while being spaced apart in the horizontal direction in the above embodiment. However, they may be shifted, for example, in the vertical direction. In short, the first receptacles need not be spaced apart in the horizontal direction. Further, the first receptacles may have different sizes and heights.

The number of the first receptacles 14 is not limited to that in the above embodiment and only has to be 2 or larger.

LIST OF REFERENCE SIGNS

10 . . . male connector (connector)
11 . . . male terminal

12 . . . male housing (housing)
12S . . . side surface of male housing
12U . . . upper surface of male housing
14 . . . first receptacle (connector fitting receptacle)
14S . . . outer side surface
15 . . . second receptacle (lever accommodating receptacle)
19 . . . clearance
30 . . . groove portion
32 . . . hole
34, 35 . . . drainage rib
40 . . . female connector (mating connector)
50 . . . board
51 . . . casing

What is claimed is:

1. A connector on an upper surface of a housing of which a casing for covering a board is to be mounted, wherein:

the housing includes a plurality of connector fitting receptacles into which a mating connector is fittable, and provided side by side while being spaced apart in a horizontal direction, and a lever accommodating receptacle arranged above the connector fitting receptacles and into which a lever for assisting a connecting operation to the mating connector is accommodated;

an upwardly open groove provided behind the lever accommodating receptacle in a connecting direction to the mating connector and extending along an arrangement direction of the connector fitting receptacles and a hole provided on a bottom part of the groove and communicating with a clearance between adjacent ones of the connector fitting receptacles.

2. The connector of claim 1, wherein a drainage rib inclined down toward a front side in the connecting direction to the mating connector is provided on an outer side surface of the connector fitting receptacle.

3. The connector of claim 1, wherein the groove is open on end parts in the arrangement direction of the connector fitting receptacles.

4. The connector of claim 3, wherein the bottom part of the groove is inclined down toward the end parts from a central part thereof in the arrangement direction of the connector fitting receptacles.

5. The connector of claim 1, wherein a length of the lever accommodating receptacle in the connecting direction to the mating connector is shorter than that of the connector fitting receptacles in the connecting direction and the groove is arranged above the connector fitting receptacles.

* * * * *